United States Patent [19]

Landa

[11] Patent Number: 4,480,825

[45] Date of Patent: Nov. 6, 1984

[54] SHEET SET SEPARATOR FOR ELECTROPHOTOGRAPHIC COPIER

[75] Inventor: Benzion Landa, Edmonton, Canada

[73] Assignee: Savin Corporation, Stamford, Conn.

[21] Appl. No.: 120,474

[22] Filed: Feb. 11, 1980

[51] Int. Cl.[3] ..... B65H 29/14; B65H 33/06

[52] U.S. Cl. ..... 271/81; 271/182; 271/184; 271/207; 271/225; 271/272; 271/314; 414/54; 414/90

[58] Field of Search ..... 271/314, 176, 184, 182, 271/183, 213, 207, 81, 225, 248, 250, 272, 273, 274; 414/54, 90

[56] References Cited

U.S. PATENT DOCUMENTS

| | | | |
|---|---|---|---|
| 2,939,702 | 6/1960 | Morrison et al. | 271/225 |
| 3,062,537 | 11/1962 | Hanstein et al. | 271/315 X |
| 3,071,373 | 1/1963 | DiVeto | 271/259 |
| 3,873,083 | 3/1975 | Fujimoto | 271/184 X |
| 3,994,487 | 11/1976 | Wicklund | 271/314 |
| 3,998,329 | 12/1976 | Araya et al. | 271/314 X |

FOREIGN PATENT DOCUMENTS

| | | | |
|---|---|---|---|
| 1256289 | 8/1970 | United Kingdom | 271/314 |

*Primary Examiner*—Bruce H. Stoner, Jr.
*Assistant Examiner*—James E. Barlow
*Attorney, Agent, or Firm*—Shenier & O'Connor

[57] ABSTRACT

Apparatus for separating sets of sheets such as copy sheets from an electrophotographic copier by delivering alternate sets of sheets to a stationary tray along overlapping laterally spaced paths. Sheets are fed first through a first, transversely fixed assembly of opposing feed rollers and then through a second, transversely movable assembly of feed rollers into a stacking tray. Sheets belonging to alternate sets are offset by shifting the second set of rollers laterally following the emergence of their trailing edges from the first set of rollers. In the preferred embodiment, the emergence of the trailing sheet edge from the first set of rollers is sensed by driving the second set of rollers at a slightly greater linear speed and sensing the retarding torque transmitted through the sheet from the first set of rollers.

2 Claims, 6 Drawing Figures

SHEET SET SEPARATOR FOR ELECTROPHOTOGRAPHIC COPIER

BACKGROUND OF THE INVENTION

This invention relates to apparatus for separating successive sets of sheets from a copier or printer and, especially, to such apparatus for separating successive sets of copy sheets from an electrophotographic copier.

Electrophotographic copiers which feed individual sheets of a stack of originals to an exposure platen a multiple number of times in recirculating fashion to produce collated sets of copies are known in the art. It is desirable that copiers of this type provide some means for facilitating the ready separation of individual collated sets of copies. One method of separating sets of copies known in the art, disclosed, for example, in U.S. Pat. No. 3,964,741 issued to Kroeker, is to feed copy sheets along a fixed feed path and shift the position of the copy tray between successive sets of copies to provide the desired offset. Such a method, however, has several disadvantages. First, since the tray may typically accommodate several hundred sheets, the mechanical assembly required to shift the tray back and forth in an accurate manner can be quite complex and expensive. Second, the size of the copying machine is undesirably increased because of the bulk of the shifting assembly. Third, the continual jarring of the sets of copies already stacked as the copy tray is shifted tends to disturb the alignment of the sheets in the tray, making their ready separation more difficult.

U.S. Pat. No. 3,630,607 issued to Korn et al discloses a copy sheet set separator for an electrophotographic copier in which a gate is selectively moved across the exit feed path to form an escrow area for accumulating sheets belonging to successive sets. Rotating elastomer vanes urge the sheets entering the escrow area transversely against a limit stop which alternates between two transversely spaced positions for successive sets of sheets. When an entire set has accumulated in the escrow area, the gate is retracted from the feed path and a pair of feed rollers move into engagement with the set to deliver it to a stacking tray. While the system shown in this patent avoids some of the defects referred to above, the complexity of the disclosed system and the necessity of accumulating an entire set of sheets before delivery of the first sheet are obvious disadvantages.

SUMMARY OF THE INVENTION

One of the objects of my invention is to provide a sheet set separator which is simple and inexpensive.

Another object of my invention is to provide a sheet separator which is compact.

Still another object of my invention is to provide a sheet set separator which produces precisely aligned sheet edges.

A further object of my invention is to provide a sheet set separator which is especially adapted to handle copy sheets from an electrophotographic copier.

Yet another object of my invention is to provide a sheet set separator which allows the operator to view the sheets as they are being accumulated.

Other and further objects will be apparent from the following description.

In general, my invention contemplates apparatus for feeding sheets in which sheets are moved along a path extending in the direction of feed and are shifted laterally through a distance corresponding to the spacing of a desired laterally spaced location in the course of movement of the sheet along the path. Preferably, the sheet is shifted laterally in the course of its longitudinal movement by shifting laterally the longitudinal feed element, which may typically comprise a pair of opposing feed rollers.

In a preferred embodiment of my invention sheets are fed through a first, transversely fixed set of opposing feed rollers and then through a second, transversely movable set of feed rollers to an ultimate destination such as a stacking tray. Sheets belonging to alternate sets are offset by shifting the second set of rollers laterally following the emergence of the trailing edge of each sheet from the first set of rollers.

Preferably the emergence of the trailing sheet edge from the first set of rollers is sensed by driving the second set of rollers at a slightly greater linear speed and sensing the retarding torque transmitted through the sheet from the first set of rollers, as also described in my copending application Ser. No. 120,475, filed concurrently herewith a continuation of which resulted in U.S. Pat. No. 4,396,187. A cylindrical cam is preferably used to shift the second set of rollers laterally at a controlled rate in synchronism with the rotation of the rollers to achieve uniform operation for a range of feed rates.

By shifting only individual sheets as they are fed to the tray rather than shifting the tray itself along with the sheets already accumulated, I am able to reduce substantially the bulk and complexity of the shifting mechanism. Not only is the mechanism itself considerably simplified, but, since the tray remains stationary during the entire stacking operation, the sheets remain aligned in their original stacked positions.

BRIEF DESCRIPTION OF THE DRAWINGS

In the accompanying drawings which form part of the instant specification and which are to be read in conjunction therewith and in which like reference numerals are used to indicate like parts in the various views.

Figure 1:
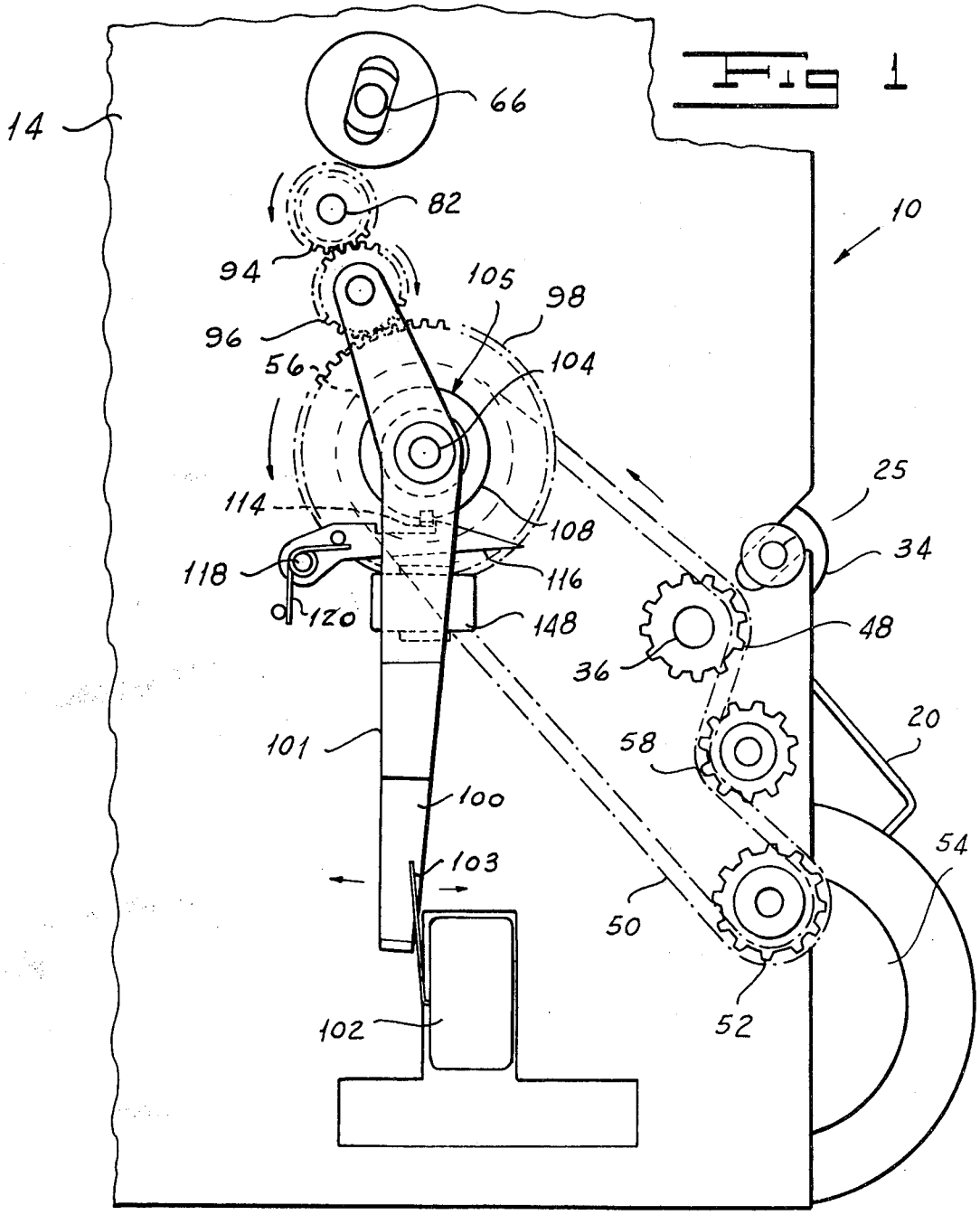
FIG. 1 is a fragmentary rear elevation of one embodiment of my sheet set separator intended for use with an electrophotographic copier.

FIG. *3a* is a fragmentary right side elevation of the front portion of the sheet set separator shown in FIG. 1, with parts omitted.

FIG. *3b* is a fragmentary right side elevation of the rear portion of the sheet set separator shown in FIG. 1, with parts omitted.

Figure 4:
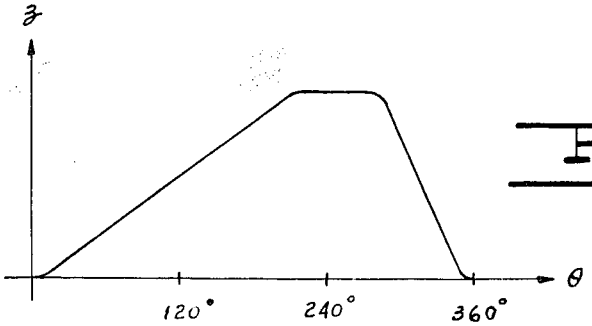

FIG. 4 is a diagram of the curve of the actuator cam of the sheet set separator shown in FIG. 1.

Figure 5:
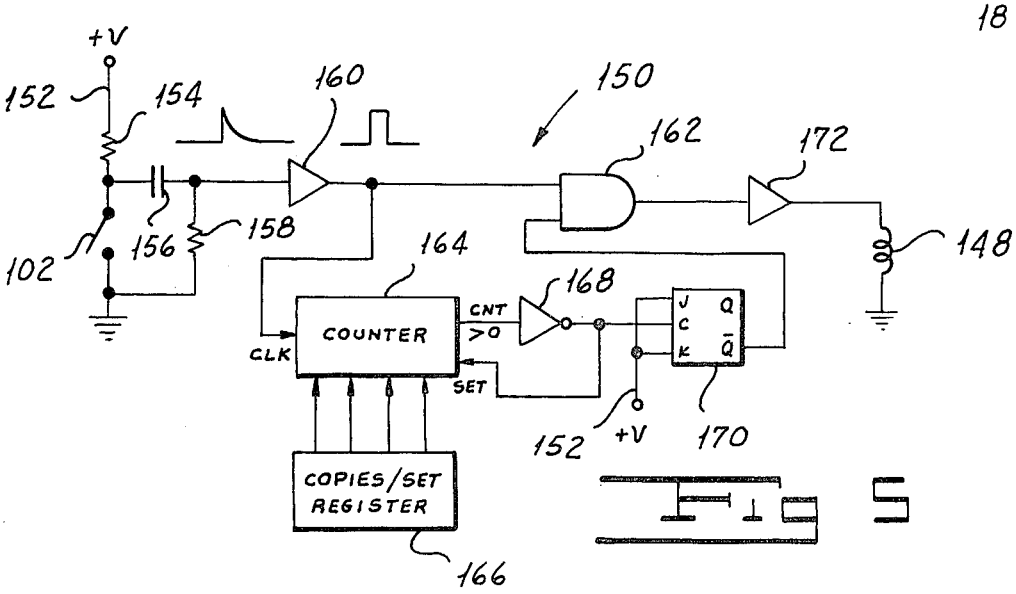
Figure 3:
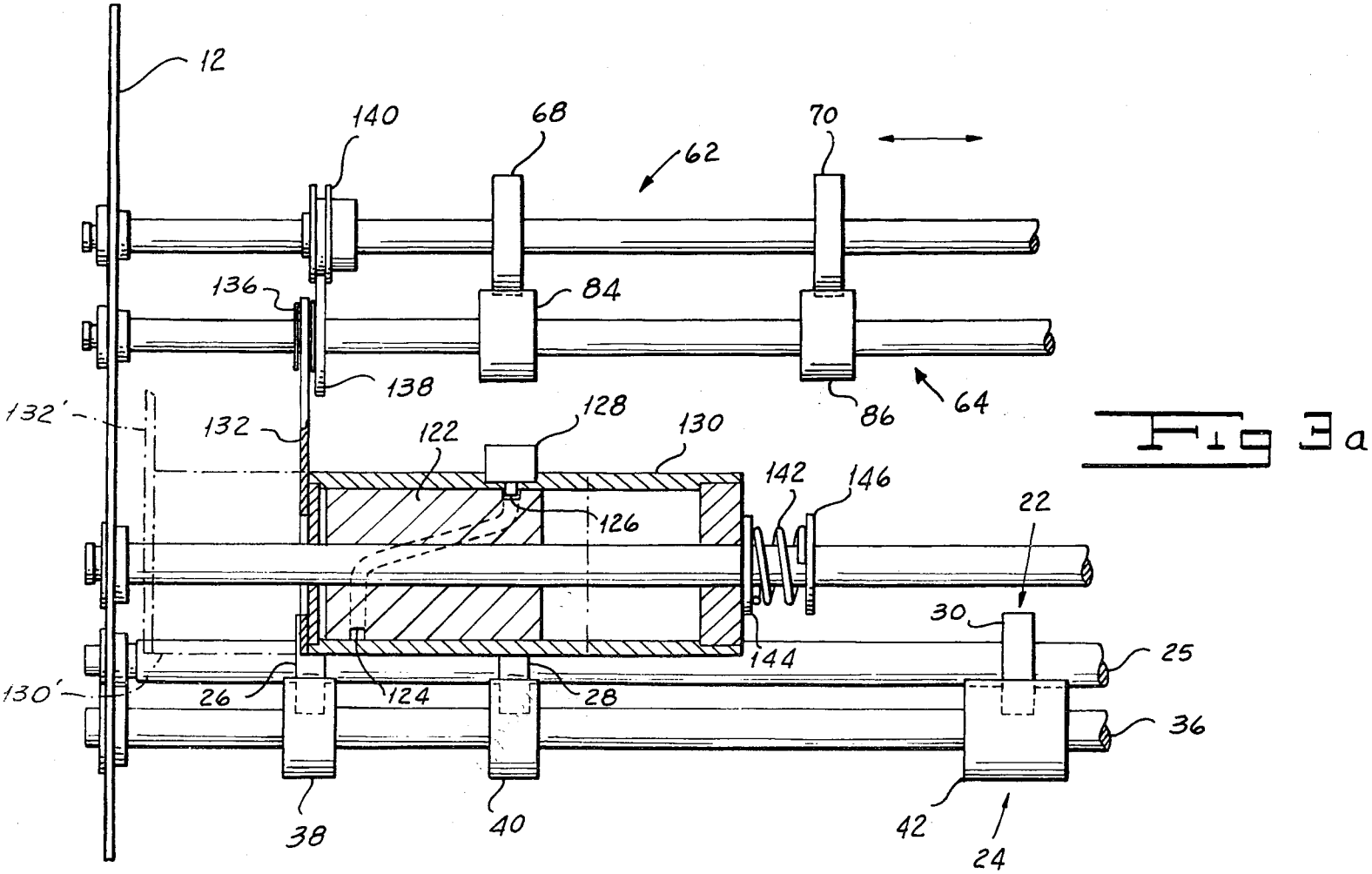
Figure 5:
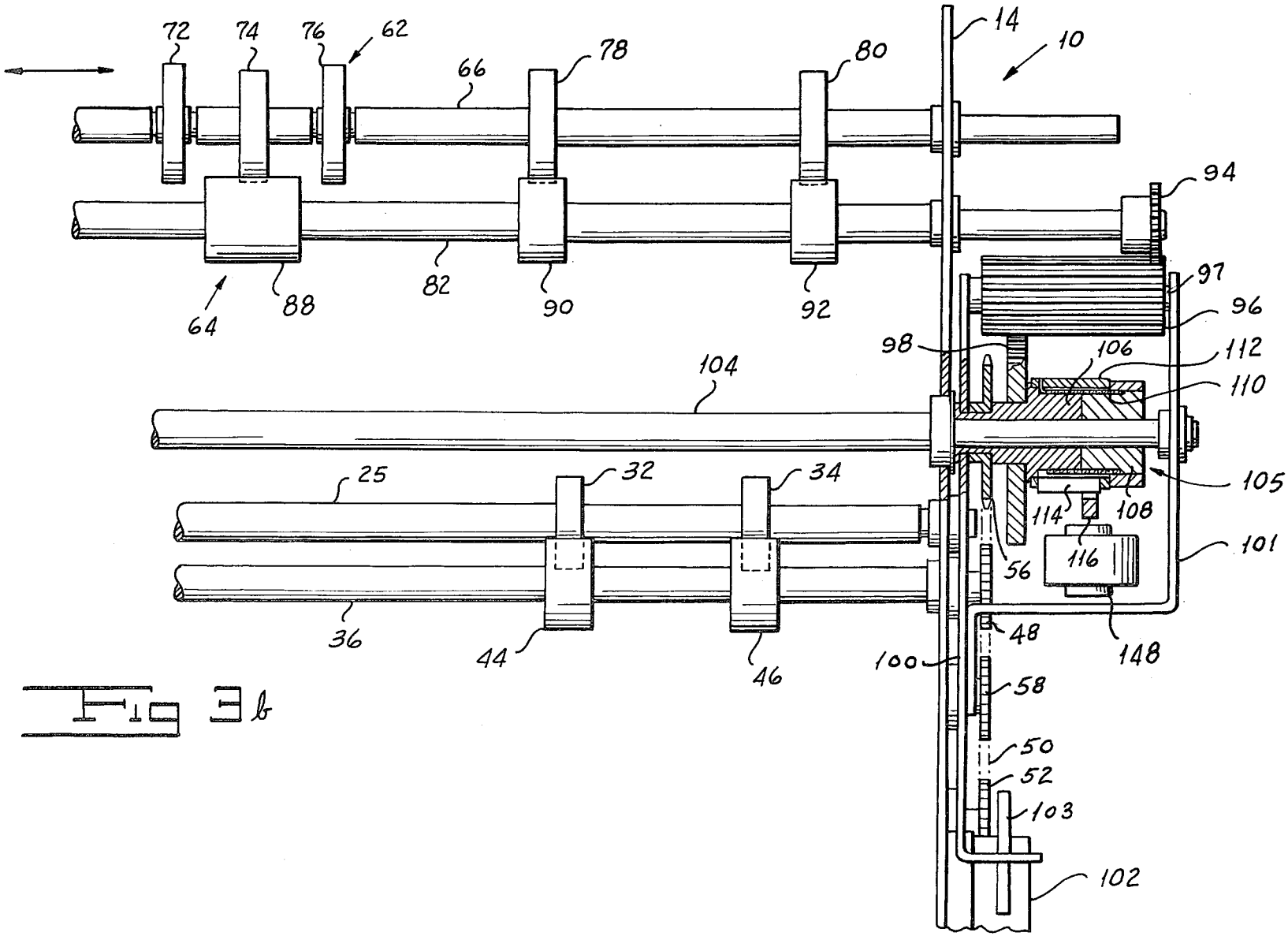

FIG. 5 is a schematic diagram of a dircuit for controlling the sheet set separator shown in FIG. 1.

DETAILED DESCRIPTION OF THE PREFERRED EMBODIMENT

Referring now to the drawings, my sheet set separator, indicated generally by the reference numeral 10, receives sheets to be separated from a pair of opposing feed rollers 16 and 18, which may be part of the copy sheet exit assembly of an electrophotographic copier (not shown). Feed rollers 16 and 18 direct a sheet of paper P onto a lower guide 20 disposed between front and rear sidewalls 12 and 14 of the separator 10. Lower guide 20 directs the sheet P upwardly at about a 45° angle between an upper fixed roller assembly indicated generally by the reference numeral 22 and an opposing lower fixed roller assembly indicated generally by the reference numeral 24.

In the upper roller assembly 22, a common shaft 25 supports for rotation therewith a plurality of transversely spaced rollers 26, 28, 30, 32 and 34. Similarly, in the lower roller assembly 24, a common shaft 36 disposed between sidewalls 12 and 14 supports for rotation therewith a plurality of rollers 38, 40, 42, 44 and 46. Rollers 38 to 46 are so arranged on shaft 36 as to oppose respective rollers 26 to 34 to form transversely spaced sheet-engaging nips. Preferably at least one of each pair of opposing rollers is formed of a relatively compliant material to allow for variations in sheet thickness and compliance. Lower roller shaft 36 extends beyond rear sidewall 14 to receive a sprocket wheel 48. A sprocket wheel 52 driven by a motor 54 carried inboard of sidewall 14 engages a drive chain 50 which passes around an idler sprocket wheel 58 and into engagement with wheel 48 to drive shaft 36. Drive chain 50 also extends around a sprocket wheel 56 rotatable about a shaft 104, to be further described.

After emerging from roller assemblies 22 and 24, the sheet of paper P follows a second or upper guide 60 arranged generally in the same plane as lower guide 20. Upper guide 60 directs the sheet between an upper reciprocating roller assembly indicated generally by the reference character 62 and an opposing lower reciprocating roller assembly indicated generally by the reference character 64. Roller assemblies 62 and 64 are so spaced from roller assemblies 22 and 24 that the leading edge of the sheet engages assemblies 62 and 64 before the trailing edge clears assemblies 22 and 24. Roller assemblies 62 and 64 feed the sheet to the top of a stack of sheets S supported by a tray 174 inclined upwardly in the direction of feed to bias the trailing edge of the stack against a backstop 176.

In the upper roller assembly 62, a shaft 66 rotatably and slidably mounted on sidewalls 12 and 14 supports a plurality of transversely spaced rollers 68, 70, 72, 74, 76, 78 and 80. Likewise, in the lower assembly 64, a shaft 82 rotatably and slidably mounted on sidewalls 12 and 14 supports a plurality of transversely spaced rollers 84, 86, 88, 90 and 92. Rollers 84 to 92 are so arranged that rollers 84, 86, 88, 90 and 92 oppose upper rollers 68, 70, 74, 78 and 80, respectively. Upper rollers 72 and 76, which do not oppose rollers of the lower assembly 64, are formed with a somewhat greater diameter than the other rollers of the upper assembly 62 to scallop the copy sheet being fed to give it a degree of flexural rigidity in the direction in which it is being fed.

Shaft 82 extends beyond sidewall 14 to receive a gear 94. Gear 94 engages an axially elongated gear 96 which engages a gear 98 which rotates along with sprocket wheel 56 about shaft 104. I mount intermediate gear 96 on a shaft 97 extending between the upper end of one arm of a bell crank 100 rotatable on shaft 104 and the upper end of a bracket 101 the offset lower end of which is secured to the bell crank by any suitable means such as welding or the like. Thus gear 96 is supported for planetary movement around gear 98. The lower end of bell crank 100 extends downwardly to engage the feeler 103 of a microswitch 102 to close the switch when bell crank 100 is subjected to a sufficient counterclockwise torque as viewed in FIG. 1.

Shaft 104 receives for rotation therewith the driven member 108 of a spring clutch indicated generally by the reference numeral 105. The driver member 106 of the clutch 105 supports gear 98 and sprocket wheel 56 for rotation therewith as a unit relative to shaft 104. A clutch spring 110 secured at one end to driven member 108 wraps around portions of driver member 106 and driven member 108 in such a direction that the driver member 106 transmits counterclockwise motion as viewed in FIG. 1 to the driven member 108 when the clutch is engaged. The free end of spring 110 engages a control ring 112 disposed coaxially around clutch spring 110 and provided at one point along its periphery with a catch 114. A latch 116 rotatably mounted on a pivot 118 carried by sidewall 14 and biased toward the spring clutch 105 by a torsion spring 120 engages the catch 114, thereby disengaging the clutch 105 whenever the catch 114 rotates to its lowermost position, shown in FIGS. 1 and **3*b*. I form latch 116 of magnetic material so that momentary energization of a solenoid 148 positioned of the other side of the latch 116 from the clutch 105 causes latch 116 to release the catch 114, allowing the clutch members 106 and 108 to become engaged and drive shaft 104 for one revolution until catch 114 again rotates to a position at which it reengages latch 116**.

Figure 2:
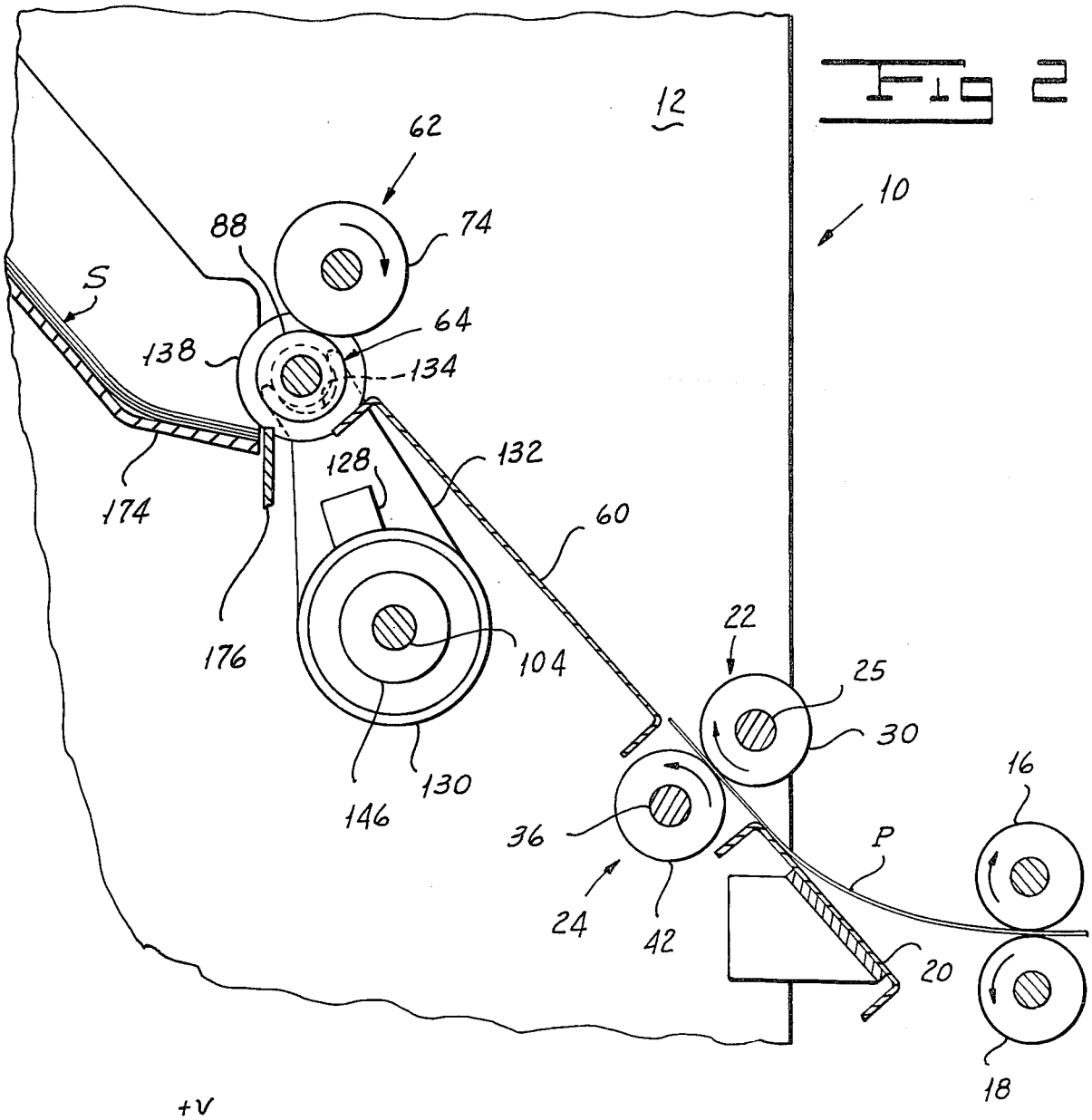
FIG. 2 is a fragmentary section of the sheet set separator shown in FIG. 1, illustrating the paper feed path.

Referring now to FIGS. 2 and **3*a*, a shaft 104 carries a cylindrical cam 122, the peripheral surface of which is formed with an endless cam track 124. A cylindrical shell 130 coaxial with cylindrical cam 122 carries a bearing 128 which in turn rotatably receives a pin 126 extending into the track 124. By rotatably mounting pin 126 in this manner, I avoid the undersirable loading effect on the cam 122 that would otherwise occur as a result of the relatively high normal forces developed between the pin and the walls of the cam track 124. Cylindrical shell 130 carries an upwardly extending arm 132 formed with a bifurcated upper end which extends into a peripheral groove formed in a collar 136 carried by shaft 82 at a fixed location along its axis. Shaft 82 also carries at a fixed axial location a disk 138 which is received in the peripheral groove of another collar 140 carried by shaft 66 at a fixed axial location. It will be apparent from the above description that rotation of the shaft 104 results in a reciprocating motion of shell 130 and arm 132 between the positions shown in solid lines and positions 130' and 132' shown in dot-dash lines, which reciprocating motion is imparted to roller assemblies 62 and 64 by arm 132 and collar 136 and by disk 138 and collar 140**.

I so form cam track 124 that the axial displacement of shell 130, and hence of roller assemblies 62 and 64, varies with the angular displacement of the camshaft 104 from its quiescent position as shown in the graph of FIG. 4. As this graph illustrates, shell 130 moves relatively slowly during its forward stroke from approximately 0° to 216° to a dwell position from approximately 216° to 288° and then moves relatively rapidly during its return stroke from approximately 288° to 360° to its original position. The dwell period, which starts before and ends after the emergence of the trailing sheet edge from roller assemblies 62 and 64, ensures that the sheet emerges while moving purely longitudinally so as to stack precisely and reliably on the tray 174. A helical compression spring 142 disposed between a first stop 144 adjacent cylindrical shell 130 and a second stop 146 carried by shaft 104 at a fixed axial location absorbs shock on the rightward, or return, stroke of the roller assemblies 62 and 64.

I so adjust the relative speeds of roller assembly shafts 36 and 82 that rollers 84 to 92 tend to drive a copy sheet at a linear speed slightly greater than the speed at which it is driven by rollers 38 to 46. As a result, whenever a single copy sheet is engaged by both the fixed roller assemblies 22 and 24 and the movable roller assemblies 62 and 64, shaft 82 experiences a retarding torque tending to rotate it clockwise as viewed in FIGS. 1 and 2. As a result of this torque, gear 94 exerts a greatly increased counterclockwise torque on bell crank 100 around shaft 104, which counterclockwise wise torque urges the lower end of bell crank 100 against the feeler of microswitch 102 with sufficient pressure to actuate the switch. Bell crank 100 and its associated assembly thus act as a torque detector for sensing the existence of a drag torque on shaft 82 due to the presence of a copy sheet spanning roller assemblies 22 and 24 and assemblies 62 and 64. When the trailing edge of the copy sheet emerges from the nip formed by roller assemblies 22 and 24, shaft 82 ceases to experience a retarding torque. As a result, since bell crank 100 ceases to press against the feeler of microswitch 102 with sufficient pressure to actuate the switch, the switch reopens.

In FIG. 5, I show an example of a circuit which may be used to control the lateral shifting of the roller assemblies 62 and 64 in response to the emergence of the trailing edge of a copy sheet from the lower roller assemblies 22 and 24. In the circuit, indicated generally by the reference numeral 150, normally open microswitch 102 is coupled between ground and a resistor 154 connected to a line 152 carrying a DC potential. A noninverting driver 160 has its input coupled to the ungrounded input of switch 102 through a capacitor 156 and to ground through a resistor 158. Driver 160 feeds one input of an AND gate 162.

Circuit 160 also drives the clock input of a programmable counter 164. Counter 164 is preset with the contents of a register 166 in response to a signal applied to a SET input and counts down by one in response to a pulse supplied to the CLK, or clock, input. Counter 164 supplies a high logic signal on an output line CNT>0 whenever its count exceeds zero. An inverter 168 responsive to this output line feeds the SET input of the counter 164 as well as the C, or clock, input of a JK flip-flop 170. Flip-flop 170 has its J and K inputs tied to the DC supply line 152 and has its $\overline{Q}$, or inverted, output coupled to the other input to AND gate 162. AND gate 162 controls solenoid 148 through a suitable noninverting driver 172. Register 166 is preset with the number of sheets in each set in any suitable manner known to the art, such as by counting the number of original documents supplied to the copier (not shown) in a single circulation of a recirculating original document feeder (not shown).

It will be apparent from the foregoing description that the input of noninverting driver 160 receives an exponentially decaying negative pulse whenever microswitch 102 is closed and receives an exponentially decaying positive pulse whenever microswitch 102 is opened when the trailing edge of a copy sheet clears roller assemblies 22 and 24. Circuit 160 responds in a digital manner to these inputs to provide a positive square pulse whenever switch 102 is reopened after being closed.

While a first set of copy sheets is being delivered to the tray 174, the input to AND gate 162 supplied by flip-flop 170 remains at zero, thereby preventing solenoid 148 from being energized. When, however, a number of copy sheets equal to the number of copies in the set has cleared the roller assemblies 22 and 24, driver 160 decrements the counter 164 to zero, causing the counter to supply a low-level logic signal to inverter 168. Inverter 168 thereupon resets counter 164 to the value stored in register 166 and at the same time supplies a clock signal to flip-flop 170, changing the level of the $\overline{Q}$ output to logic level one. As a result, on the next pulse from driver 160 following the emergence of the first copy sheet of the next set from roller assemblies 22 and 24, driver 172 energizes solenoid 148, causing shaft 104 to rotate one revolution to reciprocate roller assemblies 62 and 64. Shaft 104 thus rotates one revolution in synchronism with the emergence of the trailing edge of a copy sheet from roller assemblies 22 and 24 for each succeeding copy sheet of the second set. At the end of the second set, counter 164 again counts down to zero, triggering flip-flop 170 to reset $\overline{Q}$ to zero.

Thus, for copy sheets belonging to odd-numbered sets, solenoid 148 remains unenergized. On the other hand, for copy sheets belonging to even-numbered sets, solenoid 148 is energized in synchronism with the emergence of the trailing edge of the sheet from roller assemblies 22 and 24 thereby to shift the sheet laterally and cause it to be stacked in a laterally displaced position in the tray 174.

It will be seen that I have accomplished the objectives of my invention. My sheet set separator is simple, inexpensive and compact. My sheet set separator produces precisely aligned sheet edges and is especially adapted to handle copy sheets from an electrophotographic copier.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for feeding sheets in a direction and for delivering said sheets to a location having a lateral spacing with reference to said direction including in combination first sheet gripping means disposed along a path extending in said direction, second sheet gripping means located at a point spaced in said direction from said first means, means for driving said respective first and second gripping means to move said sheet in said direction at different speeds to tension a sheet between said first and second gripping means, means coupled to one of said gripping means for sensing the force transmitted through said sheet from the other of said gripping means, and means responsive to said sensing means for shifting said second gripping means laterally to shift said sheet through a distance corresponding to said lateral spacing.

2. Apparatus for feeding sheets along a path and for delivering said sheets to a location having a lateral spacing with references to said path including in combination first sheet gripping means, second sheet gripping means located at a point spaced along the path from said first means, means for driving the first and second gripping means in such a direction and at such different speeds as to move said sheet along said path while producing a tension in said sheet between said first and second gripping means, means for sensing changes in the tension of said sheet between said first and second gripping means, and means responsive to said sensing means for shifting said second gripping means laterally to shift said sheet through a distance corresponding to said spacing.

* * * * *